US009676027B2

(12) United States Patent
Ferrand et al.

(10) Patent No.: US 9,676,027 B2
(45) Date of Patent: Jun. 13, 2017

(54) UNDERCUT DIE CASTING AND INJECTION MOLDING SYSTEMS AND METHODS

(71) Applicant: GM Global Technology Operations LLC, Detroit, MI (US)

(72) Inventors: Michael S. Ferrand, Harrison Township, MI (US); Joel H. Pike, Haslett, MI (US); Dominick M. Ciani, Clinton Township, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 154 days.

(21) Appl. No.: 14/556,353

(22) Filed: Dec. 1, 2014

(65) Prior Publication Data

US 2016/0151835 A1 Jun. 2, 2016

(51) Int. Cl.

| | |
|---|---|
| ***B22D 17/22*** | (2006.01) |
| ***B22D 25/02*** | (2006.01) |
| ***B22D 17/26*** | (2006.01) |
| ***B22D 21/04*** | (2006.01) |

(52) U.S. Cl.

CPC ..... *B22D 25/02* (2013.01); *B22D 17/22* (2013.01); *B22D 17/266* (2013.01); *B22D 21/04* (2013.01)

(58) Field of Classification Search

CPC .. B22C 9/06; B22C 9/22; B22D 17/22; B22D 17/266; B22D 21/04; B22D 25/02; F01M 11/0004

USPC ..... 164/113, 132, 137, 312, 340, 346

See application file for complete search history.

(56) References Cited

U.S. PATENT DOCUMENTS

| | | | | |
|---|---|---|---|---|
| 5,925,303 | A * | 7/1999 | Scheliga | B29C 45/40 264/318 |
| 6,431,254 | B2 * | 8/2002 | Dittrich | 164/137 |
| 6,588,489 | B1 * | 7/2003 | Vert | B22C 9/101 123/195 C |
| 9,303,538 | B2 * | 4/2016 | Bryde | B22D 17/00 |
| 2010/0065528 | A1 * | 3/2010 | Hanafusa | B65D 53/04 215/347 |

* cited by examiner

*Primary Examiner* — Kevin E Yoon

(57) ABSTRACT

Method and system for producing a part using die casting or injection molding with a top die and undercut dies that are independently moveable from the top die. In one particular form, the method and system can include a top die and one or more undercut dies that can have a protrusion. The undercut dies can be lowered into a base of the system and moved away from each other, and the top die can be lowered into a receiving portion between the undercut dies. A molten liquid can be introduced into a space between the undercut dies and additional aspects of the system, and after cooling to form a part, the top die can be moved vertically to allow space for the undercut dies to be moved toward each other. The undercut dies can be moved vertically and the part can be removed.

15 Claims, 5 Drawing Sheets

UNDERCUT DIE CASTING AND INJECTION MOLDING SYSTEMS AND METHODS

FIELD

This application relates generally to undercut die casting and injection molding systems and methods. More specifically this application relates to a top die that is moveable independent of two undercut dies and which together can be used in systems and methods for producing parts with undercut features.

BACKGROUND

Die casting, where molten metal is inserted into a permanent mold under high pressure, is useful for large scale production of dense, fine-grained structures that have excellent wear and fatigue properties with close manufacturing tolerances because of the permanent nature of the molds. There is a need in the art for undercut die casting processes. Generally, die cast components have a top and bottom die. After a material such as aluminum has been injected into the die and the part has solidified, the top die will be lifted upwards and the part can be removed from the die.

For certain designs, due to the geometry and other constraints, the top die cannot be pulled directly upward. The component would become "locked" to the die. When these conditions exist, the use of expendable molding, such as investment casting or the like is used instead. Sand cores allow for undercut geometric features because they can be broken and shaken to get the locked core out of the component. The sand cast process uses a core made of compressed and bonded sand. These cores are not reusable and require additional machines to make them, making them unsuitable for large-scale part production. Another disadvantage is the extensive clean out process.

There has been a long-felt need in the art for a reusable system for producing undercut features in products in an efficient and effective way that can be used in conjunction with large-scale part production casting techniques such as die casting. The embodiments detailed herein overcome the outlined problems and meet the long-felt need.

SUMMARY

Specific embodiments provided herein describe a method for producing a part with an undercut feature using die casting that includes providing a system that is made up of a top die and one or more undercut dies. In specific embodiments there is a plurality of undercut dies. Undercut dies can have a protrusion or protrusions for producing the undercut feature or features. In specific embodiments the plurality of undercut dies can be lowered into a receiving portion of a base of the system. In specific embodiments the undercut dies can be moved away from each other, and in specific embodiments the top die can be lowered into the receiving portion and between the undercut dies. In specific embodiments a molten liquid or at least one molten liquid can be introduced into a space between the plurality of undercut dies and additional aspects of the system. The molten liquid can be cooled so as to form a part in a solid form where a portion of the part is directly above a portion of the protrusion. The top die can be retracted vertically allowing space for the undercut dies to retract. The undercut dies can be moved toward each other, and can be moved substantially vertically. The part can then be removed.

Additional specific embodiments describe a die casting system for producing a part with undercut features. In specific embodiments the system includes a top die, and one or more undercut dies, and each undercut die can have one or more protrusions. Specific embodiments provide for a moving mechanism configured to move the undercut dies laterally and vertically. In specific embodiments the top die can be moved vertically downward between the undercut dies, and the top die can match a shape of a space between two or more undercut dies so as to produce a form fit for die casting.

Specific embodiments herein provide for a method for producing an oil pan with undercut features using die casting. In specific embodiments the system includes one or more top dies, and can include one or more undercut dies. The undercut dies can have a bottom protrusion or protrusions, and the system can have side dies, and can have a bottom die and a top die or dies. The top dies can be configured to be moved in a vertical direction. The undercut dies can be configured to move laterally and vertically. The lower die can be placed in a receiving portion of a base of a moving mechanism of the system. In specific embodiments the side dies can be placed in the receiving portion of the base of the moving mechanism of the system and on top of the bottom die. The undercut dies can be moved into the receiving portion and between the side dies by vertically lowering the undercut dies into the receiving portion of the base. The undercut dies can be moved substantially laterally away from each other such that each of the undercut die bottom protrusions move under a portion of one of the side dies and there is a space between each of the undercut dies and each of the side dies for receiving a molten liquid such as aluminum. The top die or dies (such as two or more) can be lowered substantially vertically between each undercut die so as to contact each of the undercut dies. A molten liquid such as aluminum can be injected into the system. In specific embodiments the aluminum can be cooled to produce a part such as an oil pan. The top die can be retracted vertically allowing a space for the undercut dies to retract. The undercut dies can be moved toward each other, freeing them from the undercut feature. In specific embodiments the undercut dies can be retracted vertically from the part such as the oil pan. The side dies can be retracted and the part, such as the oil pan, can be removed.

DETAILED DESCRIPTION

Figure 1:
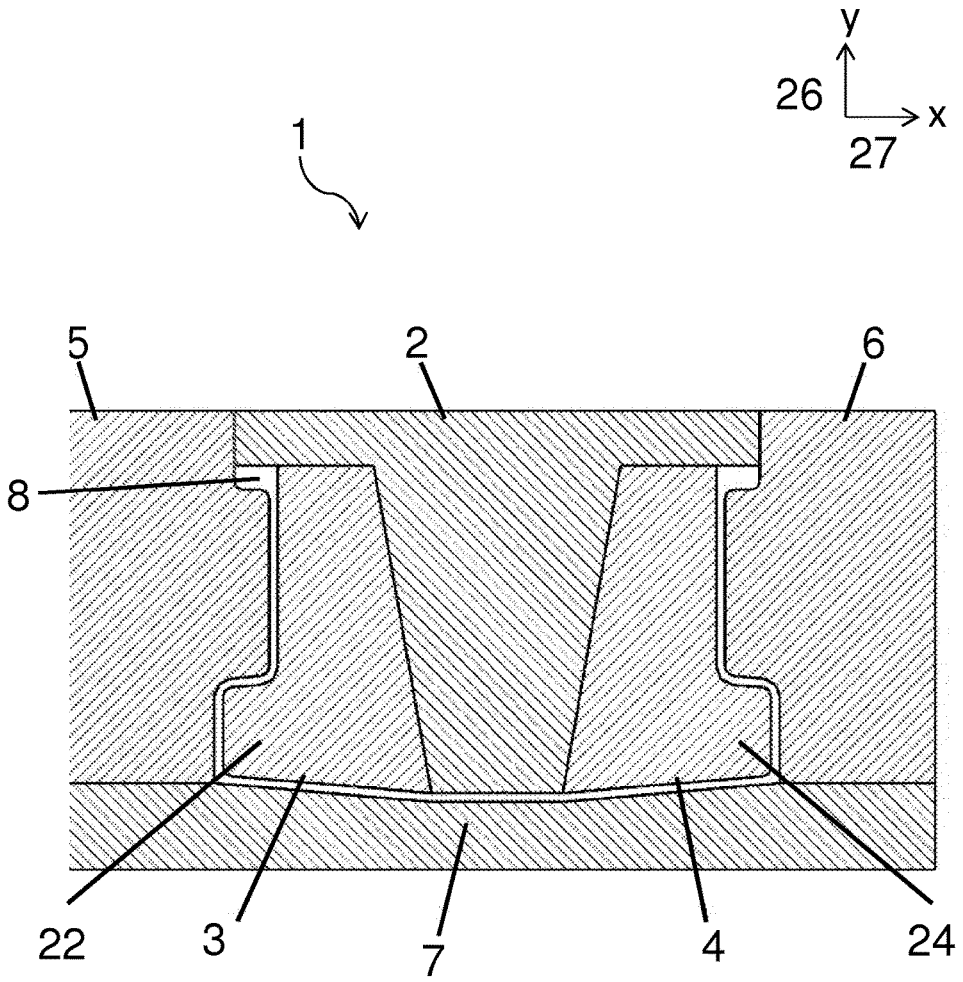
FIG. 1 illustrates an undercut die casting system as described herein.

Specific embodiments of the present disclosure will now be described. The invention may, however, be embodied in different forms and should not be construed as limited to the embodiments set forth herein. Rather, these embodiments are provided so that this disclosure will be thorough and complete, and will provide illustrative embodiments.

Unless otherwise defined, all technical and scientific terms used herein have the same meaning as commonly understood by one of ordinary skill in the art to which embodiments of this invention belong. The terminology used herein is for describing particular embodiments only and is not intended to be limiting of the invention. As used in the specification and appended claims, the singular forms "a," "an," and "the" are intended to include the plural forms as well, unless the context clearly indicates otherwise.

Unless otherwise indicated, all numbers expressing quantities of ingredients, properties such as molecular weight, reaction conditions, and so forth as used in the specification and claims are to be understood as being modified in all instances by the term "about," which is intended to mean up to ±10% of an indicated value. Additionally, the disclosure of any ranges in the specification and claims are to be understood as including the range itself and also anything subsumed therein, as well as endpoints. Unless otherwise indicated, the numerical properties set forth in the specification and claims are approximations that may vary depending on the desired properties sought to be obtained in embodiments of the present invention. Notwithstanding that numerical ranges and parameters setting forth the broad scope of embodiments of the invention are approximations, the numerical values set forth in the specific examples are reported as precisely as possible. Any numerical values, however, inherently contain certain errors necessarily resulting from error found in their respective measurements.

As used herein, the term "substantially vertically" refers generally to movement of a part as described herein in an up or down direction in accord with a standard Cartesian coordinate system along the y-axis; in specific embodiments this refers to straight up or straight down along the y-axis, and in other embodiments refers to movement in the up and/or down direction at an angle of from about zero degrees to about 45 degrees from the y-axis line.

As used herein, the term "substantially laterally" refers generally to movement of a part as described herein in a side to side direction in accord with a standard Cartesian coordinate system along the x-axis; in specific embodiments this refers to straight side to side movement, and in other embodiments refers to movement in the side to side direction at an angle of from about zero degrees to about 45 degrees from the x-axis line.

Embodiments provided herein detail a die cast process utilizing the top die 2 and two undercut dies 3, 4, that can be used together in the production of parts 8 with undercut features. The top die 2, can move substantially vertically, and the undercut dies 3, 4, can each be moved vertically and laterally. In specific embodiments one, two, or more than two dies (3, 4, 5, 6, 7, 8, 9, 10, or more) are made from tool steel and have a smooth surface finish and can be re-used for more than one, several, or many parts. In specific embodiments the undercut dies are placed in position for pouring of a material by substantially lateral and/or substantially vertical movement. The top die 2 is then substantially vertically lowered between the two undercut dies 3, 4, touching each of the two undercut dies 3, 4, and in specific embodiments form fitting against the two undercut dies 3, 4.

In specific embodiments of this process a material is introduced (such as poured or injected) into the assembled tooling. In specific embodiments the material is aluminum or aluminum alloy. In specific embodiments the material includes aluminum and/or elements of copper, magnesium, manganese, silicon, tin and zinc. Once the introduced material is cooled, the top die 2 can retract substantially vertically allowing space for the undercut dies to retract substantially laterally toward each other freeing them from the undercut feature. The undercut dies 3, 4, are then retracted substantially vertically from the part 8. The side dies 5, 6 retract substantially laterally and the part can then be removed.

Specific embodiments described herein have superior strength, excellent surface finish and material skin, low porosity, designed geometric features, and lower cost than other methods.

FIG. 1 illustrates the undercut die casting system 1 as described herein. Illustrated is the undercut die casting system 1, the top die 2, the undercut dies 3, 4, the side dies 5, 6, the lower die 7, and a part 8 upon solidification of an introduced, cooled liquid. The molten liquid can be introduced into a space between the undercut dies 3, 4, and the side dies 5, 6, as well as between the undercut dies 3, 4, and the bottom die 7, and the shape of the part 8 is formed from the shape of the space upon cooling of the liquid. In specific embodiments the part 8 is an oil pan. Also shown in FIG. 1 is a Cartesian coordinate system showing the y-axis for vertical direction 26 and the x-axis for lateral direction 27. Illustrated in FIG. 1 are the dies in position for introduction of a molten liquid to form the part 8 upon cooling of the liquid. In specific embodiments the part 8 is a an oil pan and in specific embodiments the part 8 is an oil pan with a flared bottom edge formed from bottom protrusions 22, 24 of each of the undercut dies. Oil pans produced by methods provided herein can also have a curved bottom. One or more of the undercut dies 3, 4, can have a curved bottom or can have a bottom that angles upward linearly as the undercut die 3, 4 extends to an outer periphery (away from the top die when the top die 2 is placed between the undercut dies 3, 4). In specific embodiments the undercut die 3, 4 is angled such that the widest part is at the bottom and the narrowest part is at the top. In specific embodiments, devices and/or methods described herein can provide for the oil pan with the flared bottom edge improving/being an improvement over other oil pans by increasing the volume of oil at the lowest point of the pan. This configuration and methods herein provide for increasing the volume of oil near a pick-up tube, preventing oil starvation during extreme vehicle maneuvers. In specific embodiments the flared bottom edge extends out from all of the other portions of the oil pan by about 0.1 inch to about 0.5 inch, or from about 0.1 inch to about 1 inch, or from about 0.1 inch to about 5 inches.

Figure 2:
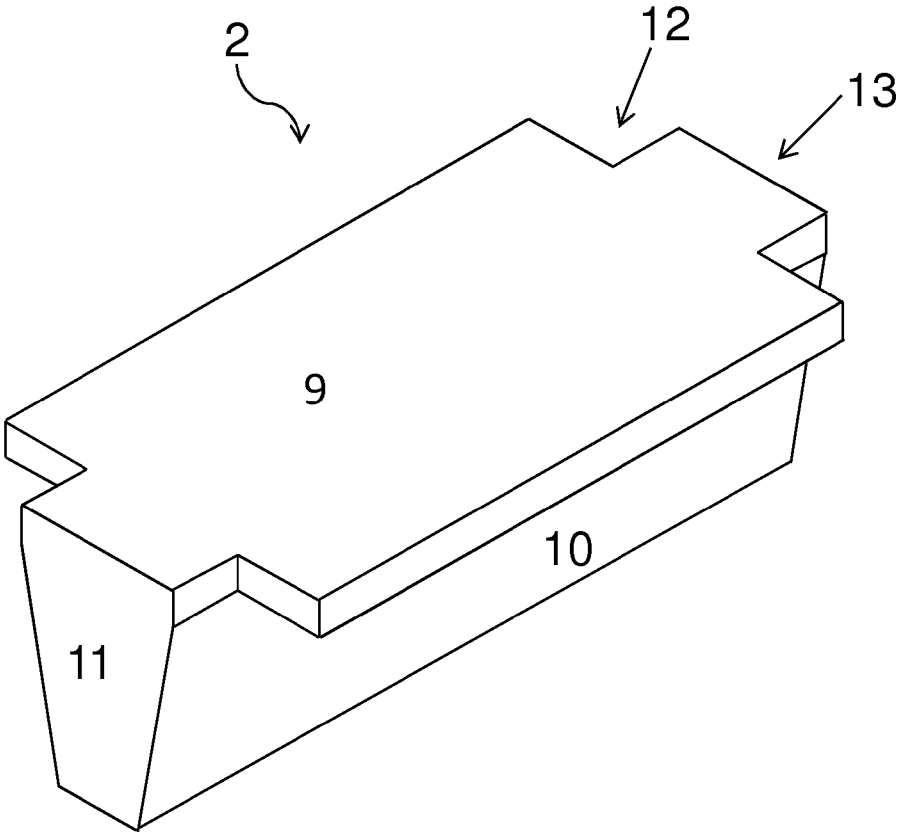
FIG. 2 illustrates a perspective view of a top die of the undercut die casting system as described herein.

FIG. 2 illustrates a perspective view of the top die 2 of the undercut die casting system 1 as described herein. Illustrated are the top 9, side 10, end 11, notch 12, and end projection 13 of the top die 2. The top die 2 has a top surface 9 that is generally rectangularly shaped, and the end projection 13 can extend out from the rectangle. In specific embodiments there are 1, 2, 3, or 4 notches 12 in the top surface 9 of the top die 2. Each notch 12 can act as a receiving point for the top of an undercut die 3, 4, which can be placed into position at the notch 12. The top of each undercut die 3, 4, can have, in specific embodiments, an opening 33 (shown in FIG. 4) such that a cylinder 25 (shown in FIG. 3) of the moving mechanism can be placed partly or fully through the opening 33 so the moving mechanism 14, 15 (shown in FIG. 3), and the undercut die 3, 4 can be coupled, allowing movement of the undercut die 3, 4, when the moving mechanism 14, 15, moves. One or more of the cylinders 25 can extend/be extended partly or fully through the undercut die 3, 4, such as from about 25 to about 50 percent through, or from about 50 to about 100 percent through the undercut die 3, 4. In specific embodiments the opening 33 does not extend all the way through the undercut dies 3, 4, and can extend, for example, about 25 percent to about 50 percent through, or about 25 to about 75 percent through, or from about 25 to about 100 percent through. In specific embodiments the cylinder 25 (and/or any cylinder described herein) has a cylindrical shape, and in other embodiments the cylinder can be of other shapes known in the art, such as round, square, rectangular, or triangular as viewed from the end. In specific embodiment the single undercut die 3, 4, has the two openings 33 configured such that one is at each end and at the top of the undercut die, such that the undercut die 3, 4, has portions that fit in the two notches 12 of the top die 2, and the undercut die 3, 4, is coupled to the moving mechanism 14, 15, at two points via two cylinders 25, 28. In specific embodiments both of the undercut dies 3, 4, have the two openings 33, and there are connections to the moving mechanism 14, 15 via four total cylinders 25, 28 (additional two cylinders are shown in FIG. 4) for the two dies 3, 4.

Figure 3:
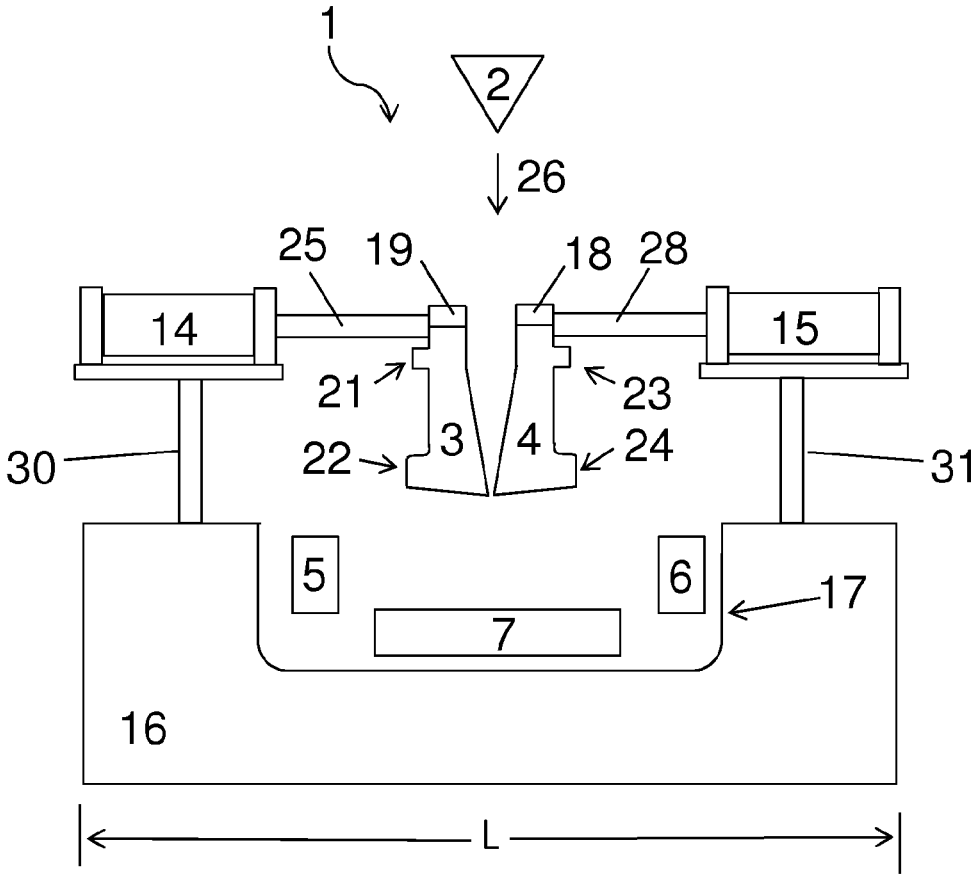
FIG. 3 illustrates the moving mechanism of the undercut die casting system, depicting undercut dies, side dies, lower die, top die, and base with receiving portion of the undercut die casting system as described herein.
Figure 4:
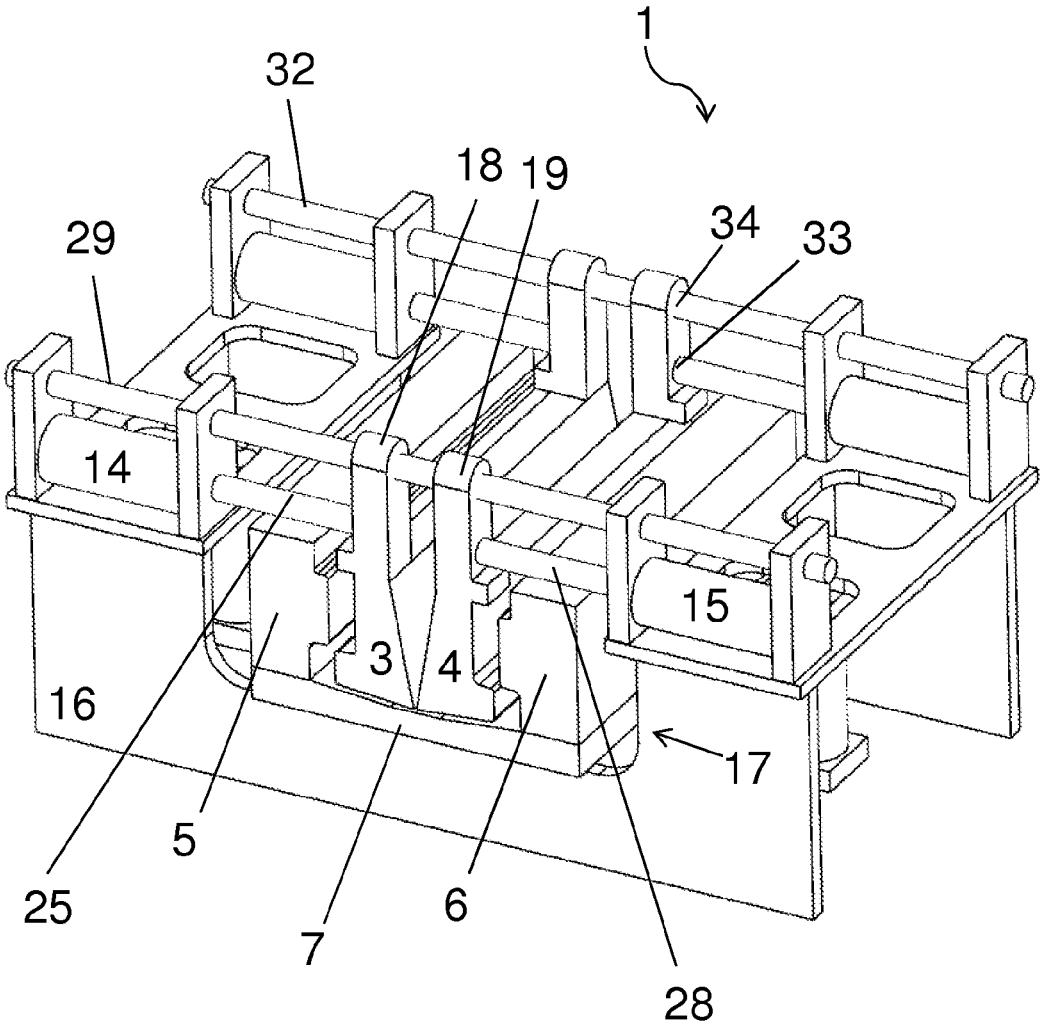
FIG. 4 illustrates a perspective view of the moving mechanism of the undercut die casting system of FIG. 3 depicting guide bars.

FIG. 3 illustrates the moving mechanism 14, 15, the undercut dies 3, 4, the side dies 5, 6, the lower die 7, the top die 2, and base 16 with receiving portion 17 of the undercut die casting system 1 as described herein. The moving mechanism 14, 15 can have the cylinders 25, 28, configured for coupling of each of the undercut dies 3, 4 at the top of the undercut dies 3, 4 via the openings 33. The undercut dies 3, 4 can have top protrusions 21, 23, and bottom protrusions 22, 24. In specific embodiments there are a plurality of undercut dies 3, 4 such as 2, 3, 4, 5, 6, 7, 8, 9, 10, or from about 1 to about 5, or from about 1 to about 10, or from about 2 to about 5, or from about 2 to about 10. Specific embodiments provide for one undercut die to be used with a top die as described herein, the one undercut die 3, 4 and the top die 2 configured to be used with one or two sides dies 5, 6 to provide the part 8; in specific embodiments two undercut dies are used though only one has a protrusion, such that a part is produced with an undercut feature on one side. Also shown in FIG. 3 is an arrow indicating vertical movement 26 (in this case downward) of the top die 2 for top die 2 placement prior to introducing a material which can be via pouring. The cylindrical parts 25, 28 can move laterally forward and/or back (corresponding to left and/or right on the page of FIG. 3), moving the undercut dies 3, 4, about half the length L of the base 16; in specific embodiments the lateral movement of the undercut dies 3, 4, by the cylindrical parts 25, 28, can be from about 0 to about 10 percent of the base length L, or about 0 to about 20 percent, or about 0 to about 50 percent, or from about 0 to about 75 percent of the base length, or from about 50 to about 75 percent of the base length L. Also shown in FIG. 3 are cylinders 30, 31 which can move the undercut dies vertically up and/or down.

In specific embodiments the openings 33 in one or more of the undercut dies 3, 4, are: round, square, triangular, or irregularly shaped, and in specific embodiments the undercut dies 3, 4, are from about 0.1 inch to 0.5 inches in diameter, or from about 0.1 to about 1 inch in diameter.

In specific embodiments one or more of the undercut dies has: one, two, three, four, five, six, seven, eight, nine, or ten protrusions; specific embodiments have from about one to about five or from about one to about ten protrusions. One or more of the protrusions can be greater than 0.1 inches in length and/or diameter, such as about 0.1 to about 0.5 inch, and/or 0.1 to about 1 inch, and/or from about 0.1 to about 5 inches.

In specific embodiments the undercut die casting system 1 is automated, and the movement of the top die 2 and the undercut dies 3, 4, is performed by robotics from preprogrammed instructions. The robotics can include a separate mechanism for movement of the top die 2 than for any other die. The robotics can include a robotic arm for moving the top die 2.

In specific embodiments one or more parts of the methods are herein repeated for the production of 1, 2, 5, 10, or more parts 8.

In specific embodiments the method is used with injection molding. In specific embodiments plastics are used in molten liquid form to create the parts 8. In specific embodiments the part is produced with injection molding with a host of materials, including metals, glasses, elastomers, confections, thermoplastic, thermosetting polymers, or any combination of these materials.

In specific embodiments liquid material such as molten liquid material is poured into the undercut die casting system 1. In specific embodiments molten liquid material is forced into position and cooled to form a shape.

In specific embodiments one or more components of the undercut die system 1 has one or more ball bearings attached, such as at points where two dies or other components touch, to reduce friction. In specific embodiments the one or both sides 10 of the top die 2 has one, two, three, four, five, six, seven, eight, nine, or ten ball bearings attached to the top die 2 so as to reduce friction with other dies. In specific embodiments, at least one side 10 of the top die 2 has from about 1 to about 5 ball bearings, or from about 1 to about 20 ball bearings. In specific embodiments one or more of the bearings is of a spherical shape. In specific embodiments the bearing or bearings are within a separate part affixed to the top die 2, the separate part being configured so as to provide for the bearings to move freely within the separate part.

FIG. 4 illustrates a perspective view of the moving mechanism 14, 15 of the undercut die casting system 1 of FIG. 3 depicting guide bar(s) 29, 32. The guide bars 29, 32 can provide structural support, supporting the weight of the undercut dies 3, 4. In specific embodiments guide bars 29, 32 are at the top of the die casting system 1, in specific embodiments extending the length or substantially the entire length of the base 16 of the die casting system 1; in specific embodiments the die casting system 1 has two undercut dies 3, 4 and two guide bars 29, 32, each of the guide bars 29, 32 extending through two of the undercut dies 3, 4 at opposing sides of the base 16; in specific embodiments a guide bar 29 extends entirely through an opening 34 at the top of one or more of the undercut dies 3, 4. The opening 34 is labeled in FIG. 4 at the back-side for ease of view, though the opening 34 (and the opening 33 also labeled in FIG. 4) are also depicted at the front side of the undercut die cast system 1. The guide bars 29, 32 can be stationary, and in specific embodiments the undercut dies 3, 4 can be moved along the guide bar or bars 29, 32 in opposing directions (toward and/or away from each other) by the cylinders 25, 28. The guide bar or bars 29, 32 can be above or below the cylinders 25, 28. In specific embodiments the guide bars 29, 32 remain coupled to the undercut dies 3, 4 throughout part or all of the methods provided herein; the top die 2 can be set in place between the guide bars 29, 32, such that the part 8 can be made, and the guide bars 29, 32, support the weight of the undercut dies 3, 4, through lateral and vertical movements or the entire process of producing the part 8. Methods provided herein can include coupling the undercut dies 3, 4, to one, two, or more than two guide bars 29, 32. In specific embodiments the die casting system 1 has four guide bars (only two are shown in FIG. 4), slideable from each corner of the top of the base and extending toward a center line of the die casting system 1 to engage the undercut dies 3, 4. In specific embodiments the guide bars 29, 32 can be slid in place and locked in place. Also shown in FIG. 4 are: the lower die 7, the side dies 5, 6, receiving portion of the base 17, and undercut die tops 18, 19.

Figure 5:
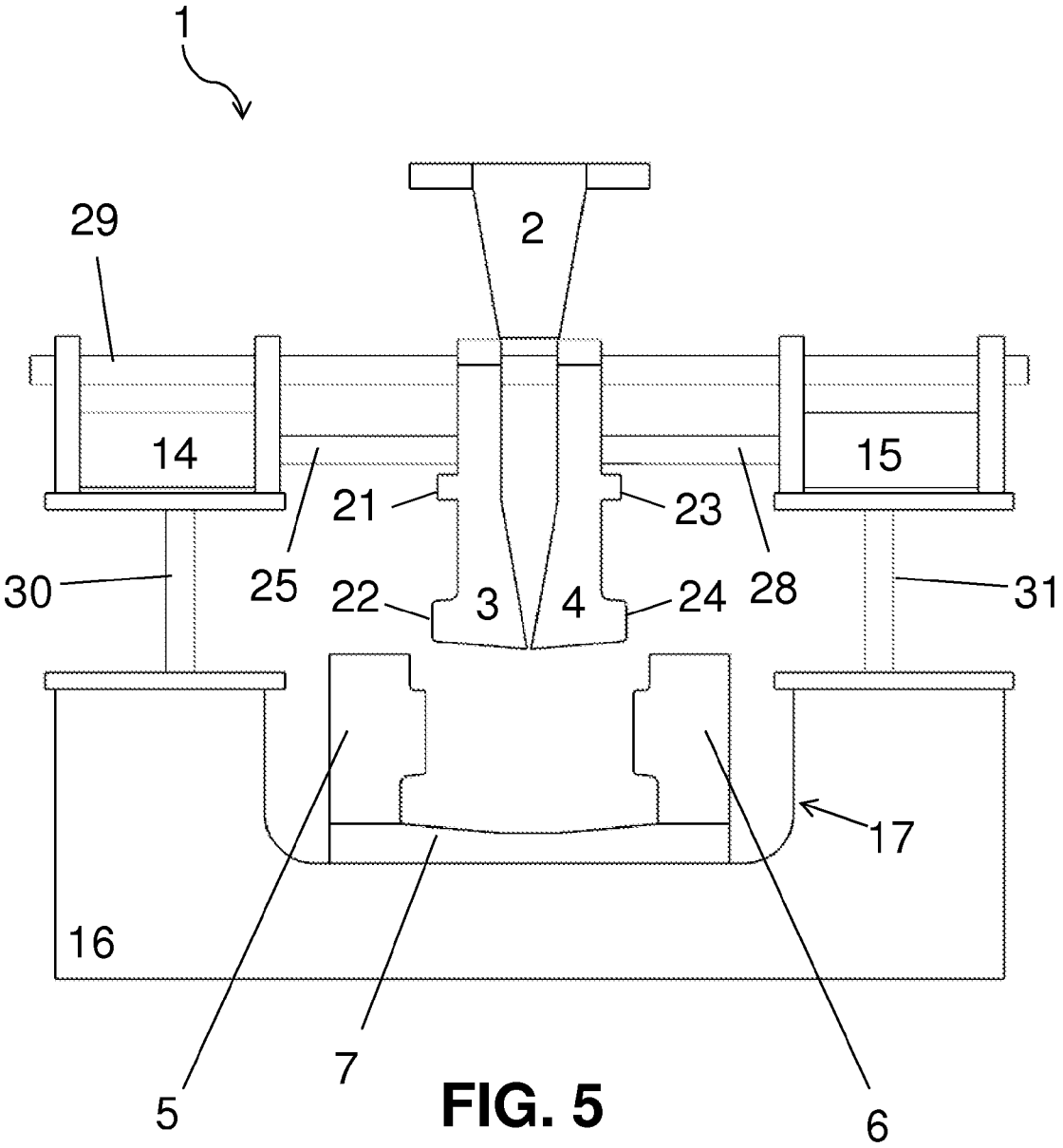
FIG. 5 illustrates the moving mechanism of the undercut die casting system of FIG. 4 depicting guide bars and the top die positioned between the two undercut dies.

FIG. 5 illustrates the moving mechanism 14, 15 of the undercut die casting system 1 of FIG. 4 depicting a guide bar 29 and the top die 2 placed between the two undercut dies 3, 4. Also depicted are: the side dies 5, 6, the bottom die 7, the base 16, the receiving portion of the base 17, the top protrusions 21, 23, bottom protrusions 22, 24, and the cylinders 25, 28, 30, and 31.

In specific embodiments devices and methods provided herein can be used to produce the part 8, wherein the part is an automotive application such as but not limited to: intake manifolds, plenums (air boxes), coolant overflow container, wiper fluid containers, battery trays, and/or HVAC components.

In specific embodiments devices and methods provided herein can be used to accommodate back up material for bolt bosses or fluid passageways or other shape that may cause an undercut condition.

In specific embodiments devices and methods provided herein can be used for non-automotive uses which require or feature an undercut situation.

In specific embodiments devices and methods provided herein can be used to aid packaging concerns by utilizing open voids.

In specific embodiments the oven temperature used in producing the part is 675 degrees Celsius. In specific embodiments the part is produced at from about 675 degrees Celsius to about 700 degrees Celsius, or from about 675 degrees Celsius to about 750 degrees Celsius, or from about 675 degrees Celsius to about 775 degrees Celsius.

In specific embodiments an oil pan is the part 8 produced. In specific embodiments the dimensions of the oil pan are 520 millimeters long, 258 millimeters wide, and 170 millimeters tall, with the bottom flare being 30 millimeters. In specific embodiments the oil pan length is from about 450 to about 550 millimeters long, the length is from about 225 to 325 millimeters wide, the height is about 125 to about 225 millimeters tall, and the flare out at the bottom is from about 1 millimeter to about 50 millimeters.

Specific systems and methods are described herein have or use: producing the part 8 comprising an oil pan comprising a bottom flare; ball bearings attached to a side of the top die 2; the at least one protrusion comprises one protrusion extending laterally from at least one of the two undercut dies, such that the protrusion extends laterally beyond the perimeter of any other portion of the at least one of the two undercut dies 3, 4; the at least one protrusion comprises one bottom protrusion 22, 24 and one top protrusion 21, 23 on each of the two undercut dies 3, 4; the top die 2 comprises a taper such that a top surface 9 has a largest surface area for any surface of the top die 2 and a bottom surface of the top die 2 has a smallest surface area for the any surface of the top die 2; the molten liquid (such as for a part 8) comprises at least one of a metal and a plastic; the metal comprises aluminum; the metal comprises from about 40 percent to about 100 percent aluminum; the plurality of undercut dies consists of two undercut dies of a first undercut die and a second undercut die, at least one of which defines said at least one protrusion; the part 8 comprises an oil pan with a bottom flare; each of the two undercut dies 3, 4 has two top openings 33 for coupling to the moving mechanism 14, 15, and a cylindrical portion of the moving mechanism extends into each of the openings 33 so as to support and move the undercut dies 3, 4; the moving mechanism 14, 15 is hydraulically powered; the top die 2 comprises an end projection 13 and comprises a notch 12 at each of the four corners of the top die 2; the undercut dies 3, 4 are each moved laterally away from each other more than 0.1 inch; the lowering of the top die 2 comprises a hydraulic mechanism that is physically separate from the moving mechanism 14, 15; and/or sliding a guide bar 29, 32, through each of the undercut dies for an opening 34 to provide support.

What is claimed is:

1. A method for producing a part with an undercut feature using die casting comprising:

utilizing a system comprising:

a top die; and a plurality of undercut dies, wherein ball bearings are attached to a side of the top die, and wherein at least one of the plurality of undercut dies has a protrusion for producing the undercut feature;

lowering the plurality of undercut dies into a receiving portion of a base of the system;

moving the plurality of undercut dies away from each other;

lowering the top die into the receiving portion and between the plurality of undercut dies;

introducing a molten liquid into a space between the plurality of undercut dies and additional aspects of the system;

cooling the molten liquid forming the part in a solid form where a portion of the part is directly above a portion of the protrusion;

retracting the top die substantially vertically allowing space for the undercut dies to retract;

moving the plurality of undercut dies toward each other; and moving the plurality of undercut dies substantially vertically.

2. The method of claim 1 further comprising producing the part comprising an oil pan comprising a bottom flare.

3. The method of claim 1 wherein the molten liquid comprises at least one of a metal and a plastic.

4. The method of claim 3 wherein the metal comprises aluminum.

5. The method of claim 4 wherein the metal comprises from about 40 percent to about 100 percent aluminum.

6. A method for producing an oil pan with undercut features using die casting comprising:

providing a system comprising a top die, a plurality of undercut dies each having a bottom protrusion, side dies, and a bottom die, the top die configured to be moveable in a substantially vertical direction, and each of the plurality of undercut dies being configured to be moveable in a substantially lateral direction and the substantially vertical direction;

placing a lower die in a receiving portion of a base of a moving mechanism of the system, placing each of the side dies in the receiving portion of the base of the moving mechanism of the system and on top of the bottom die, moving each of the undercut dies into the receiving portion and between the side dies by vertically lowering the undercut dies into the receiving portion of the base;

moving the undercut dies substantially laterally away from each other such that each of the undercut die bottom protrusions move under a portion of one of the side dies and there is a space between each of the undercut dies and each of the side dies for receiving aluminum;

lowering the top die substantially vertically between each of the plurality of undercut dies so as to contact each of the undercut dies;

injecting the aluminum into the system;

cooling the aluminum to produce the oil pan;

retracting the top die vertically allowing a space for the undercut dies to retract;

moving the undercut dies toward each other, freeing them from the undercut feature;

retracting the undercut dies vertically from the oil pan;

retracting the side dies; and removing the oil pan.

7. The method of claim 6 wherein the undercut dies are each moved laterally away from each other more than 0.1 inch.

8. The method of claim 6 further comprising performing the lowering of the top die with a separate mechanism from the moving mechanism.

9. The method of claim 6 further comprising sliding a guide bar through an opening in each of the undercut dies to provide support.

10. A method for producing an oil pan with an undercut feature using die casting comprising:

utilizing a system comprising:

a top die; and a plurality of undercut dies, wherein at least one of the plurality of undercut dies has a protrusion for producing the undercut feature;

lowering the plurality of undercut dies into a receiving portion of a base of the system;

moving the plurality of undercut dies away from each other;

lowering the top die into the receiving portion and between the plurality of undercut dies;

introducing a molten liquid into a space between the plurality of undercut dies and additional aspects of the system;

cooling the molten liquid forming the oil pan in a solid form where a portion of the oil pan is directly above a portion of the protrusion;

retracting the top die substantially vertically allowing space for the undercut dies to retract;

moving the plurality of undercut dies toward each other; and moving the plurality of undercut dies substantially vertically.

11. The method of claim 10 wherein the oil pan further comprises a bottom flare.

12. The method of claim 10 wherein the top die further comprises ball bearings attached to a side of the top die.

13. The method of claim 10 wherein the molten liquid comprises at least one of a metal and a plastic.

14. The method of claim 13 wherein the metal comprises aluminum.

15. The method of claim 14 wherein the metal comprises from about 40 percent to about 100 percent aluminum.

* * * * *